United States Patent [19]

Furse

[11] 3,949,820

[45] Apr. 13, 1976

[54] UNDERREAMER CUTTER ARM

[75] Inventor: John H. Furse, Anchorage Branch, Ky.

[73] Assignee: Smith International, Inc., Long Beach, Calif.

[22] Filed: Feb. 21, 1975

[21] Appl. No.: 551,600

[52] U.S. Cl. ..... 175/286
[51] Int. Cl.[2] ..... E21B 9/26
[58] Field of Search ..... 175/284, 286, 263, 258, 175/267–269, 279, 289, 339

[56] References Cited

UNITED STATES PATENTS

| | | | |
|---|---|---|---|
| 384,625 | 6/1888 | Herberg | 175/267 |
| 2,069,482 | 2/1937 | Seay | 175/269 |
| 2,177,721 | 10/1939 | Johnson et al. | 175/267 |
| 2,344,598 | 3/1944 | Church | 175/286 |
| 3,552,509 | 1/1971 | Brown | 175/258 |
| 3,749,187 | 7/1973 | Leathers | 175/287 |
| 3,817,339 | 6/1974 | Furse | 175/271 |

*Primary Examiner*—James A. Leppink
*Attorney, Agent, or Firm*—Christie, Parker & Hale

[57] ABSTRACT

A hole drilling tool, useful in mining operations for enlarging the lower portion of a hole for explosives, is described. This underreamer has arms movable between a retracted position and an extended position for underreaming in response to weight of the drill string above the tool. The two cutter arms are urged outwardly into their extended position by a cam connected to the upper end of the drill string. In effect the cutter arms are connected to the lower end of the drill string which can telescope relative to the upper end. An air flow passage extends from the tool body through the cutter arms for cooling the cutter bearings.

12 Claims, 8 Drawing Figures

UNDERREAMER CUTTER ARM

BACKGROUND

Rotary drills are commonly used for earth boring operations. Such drills are employed in oil and gas wells where the drill string proceeds to great depths. In such operations a drilling "mud" is typically pumped down the drill string for cooling the drilling cutters. When drilling oil and gas wells it is sometimes desirable to "underream" the hole, that is to enlarge the diameter of the hole being drilled at some point a substantial distance below the surface. To effect this, a variety of underreamers, hole openers or the like have been devised. In such operations the fluid pressure due to the drilling mud can be employed for actuating the underreaming tool. In deep well drilling operations it is typical to withdraw the drill string from the hole and install a suitable underreamer either alone or in series with a conventional pilot drill. When the drill string has been tripped back into the hole, pressure of drilling fluid is applied and through any of a variety of prior mechanisms the cutter arms on the underreamer are urged outwardly for enlarging the selected portion of the hole. After drilling, the cutter arms are retracted and the underreamer withdrawn from the hole. Typically such underreamers are extended whenever drilling fluid pressure is applied, which is at all times when drilling is being conducted.

In mining operations it is typical to use somewhat shorter drill strings which do not extend so deeply into the ground and the drilling fluid is often compressed air instead of a slurry of mud and water. Generally speaking the air pressure is not sufficient for actuating the heavy cutter arms of an underreamer. Underreaming is desirable in many mining operations for enlarging the lower portion of a drill hole so that an adequate quantity of explosives can be inserted for breaking the earth formations and permitting mucking of the fragmented earth.

Since the drill strings are shorter, tool wear does not require round tripping of the drill string during the course of most drilling operations. It is therefore desirable to have a means for underreaming a blast hole without first withdrawing the drill string and installing an underreamer. It is also desirable to have an underreamer that can be actuated by means other than the fluid pressure of drilling fluid. Since the underreamer should be in the drill string during drilling of the pilot hole it is desirable to have means for latching the underreamer so that its cutting arms are in a retracted position during at least a portion of the drilling operations.

An arrangement for latching an underreamer by means of air pressure is described in my U.S. Pat. No. 3,817,339 issued June 18, 1974. As described in that patent it is also desirable that the underreamer have fluid passages whereby a portion of cooling fluid can flow to the underreamer arms while another portion flows through a parallel path to a drilling tool connected beneath the underreamer. Cutter arms in accordance with that patent are further described herein.

BRIEF SUMMARY OF THE INVENTION

There is, therefore, provided in practice of this invention according to a presently preferred embodiment, an underreamer cutter arm comprising an elongated body with a transverse pivot pin hole therethrough. A cam surface is provided on one end of the body for pivoting it about the axis of the pivot pin hole. A journal is provided on the other end of the body for mounting a rock cutter cone for rotation about an axis transverse to the axis of the pivot pin hole. A fluid flow passage extends through the body between the pivot pin hole and the journal for cooling the journal. Preferably the cutter arm has a half width portion at the end adjacent the cam and pivot pin hole so that a pair of such arms can be interconnected by a pivot pin having a fluid flow passage. therethrough for pivoting in a scissors fashion. To effect this, the cam surface and the journal face in the same rotational sense relative to the axis of the pivot pin hole.

DRAWINGS

These and other features and advantages of the present invention will be appreciated as the same becomes better understood by reference to the following detailed description of a presently preferred embodiment when considered in connection with the accompanying drawings wherein.

DESCRIPTION

Figure 1:
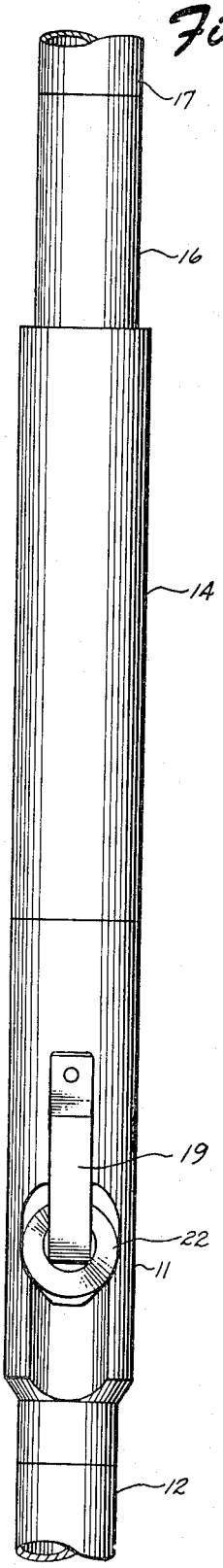
FIG. 1 illustrates in side view a combined underreamer and latching selector sub constructed according to principles of this invention.
Figure 2:
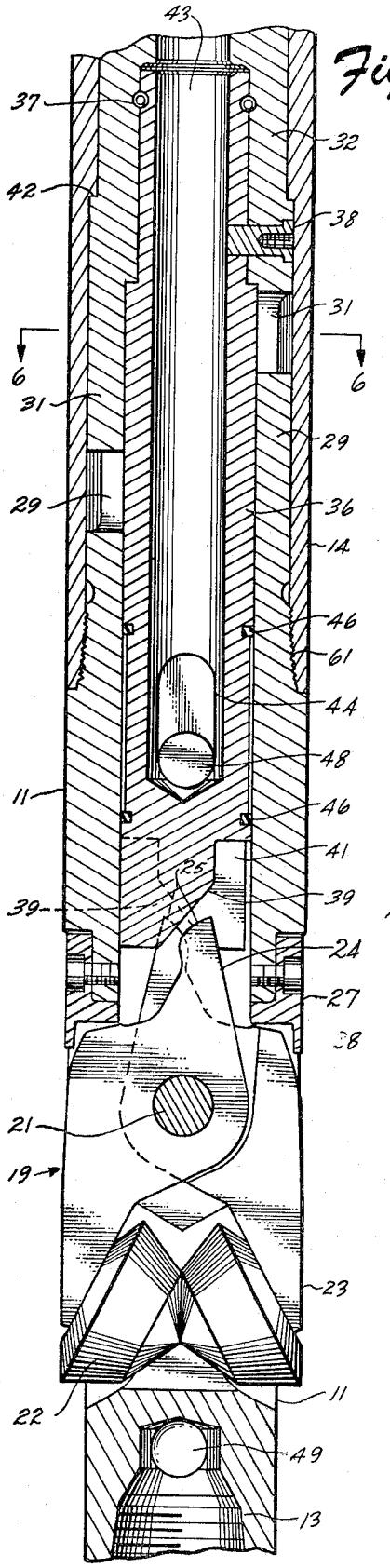
FIG. 2 illustrates in longitudinal cross section the lower underreamer portion of the combination of FIG. 1 with cutter arms in a retracted position.

FIG. 1 illustrates in side view a combined underreamer and latching selector sub containing cutter arms constructed according to principles of this invention. As illustrated in this presently preferred embodiment the underreamer has a lower body portion 11 which is connected to a lower portion of a drill string 12 by a conventional threaded joint 13 (FIG. 2). The lower portion 12 of the drill string typically includes a conventional drill (not shown) for forming a hole in the earth as the drill string is rotated. Such drills are conventional and, forming no part of this invention, are not further described herein. The drill is usually coupled directly to the underreamer.

A sleeve 14 is connected to the lower body 11 and extends upwardly to surround a portion of a latching selector sub 16. The upper end of the latching selector sub is connected to the upper portion 17 of a drill string by a conventional threaded joint. The upper drill string is a series of pipes connected to a rotary drilling rig.

Figure 4:
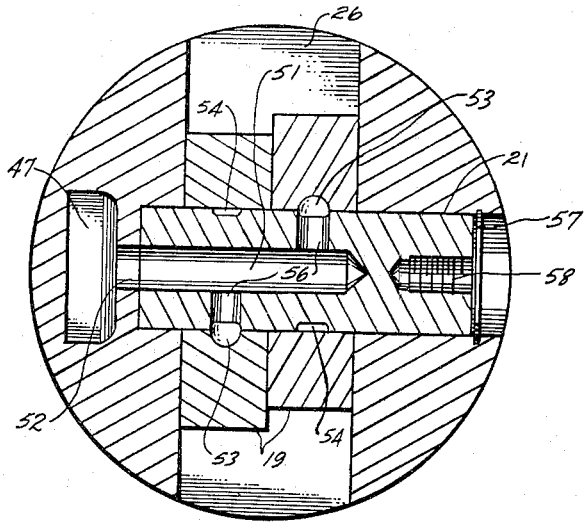
FIG. 4 is a transverse cross section of the underreamer at the pivot for the cutter arms.

A pair of cutter arms 19, better seen in FIGS. 2 to 5, 7 and 8 are mounted on the lower body 11 by a pivot pin 21. Rock crushing cutters 22 of the conventional sort, and illustrated schematically are mounted for rotation on the lower ends of the two cutter arms 19 respectively. Each cutter arm has a lower portion 23 on which the cutter 22 is mounted and an upper follower portion 24 on the opposite side of the pivot pin 21. The upper portions 24 are each half the width of the lower portion 23 so that the two arms are mounted on the pivot pin in a scissors fashion. A curved follower 25 is formed at the upper end of the upper portion 24 of each cutter arm. As best seen in FIG. 4, the arms are mounted in a slot 26 extending across the lower body 11. In the lower portion the arms are the full width of the slot so that the cutters are radially outwardly from the center line of the underreamer. The half width portions of the cutter arms are on opposite sides of the center line of the underreamer and can swing past each other so that the two arms swing in opposite directions.

Figure 3:
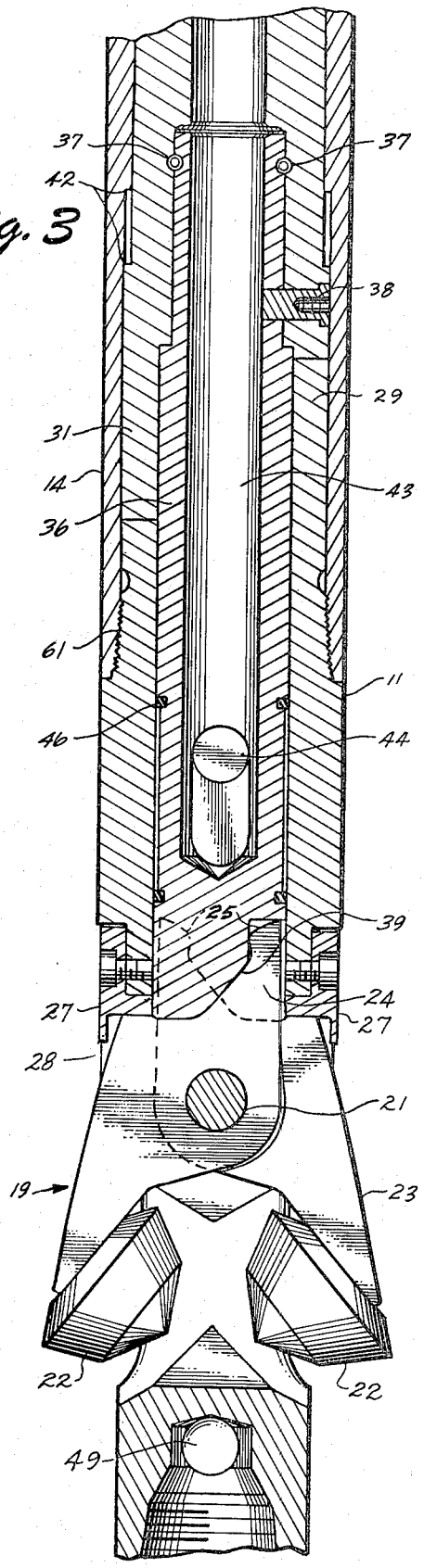
FIG. 3 is a longitudinal cross section similar to FIG. 2 with the cutter arms extended.

A stop lug 27 is bolted onto the lower body 11 to partially close the sides of the slot. The stop lugs are inactive when the cutter arms are in their retracted position as seen in FIG. 2. When the cutter arms are extended as illustrated in FIG. 3, a shoulder 28 on each cutter arm engages the respective stop lug 27 and limits the outward extent of the cutters. Engagement of the shoulders with the stop lugs determines the size of the underreamed portion of the hole.

Figure 6:
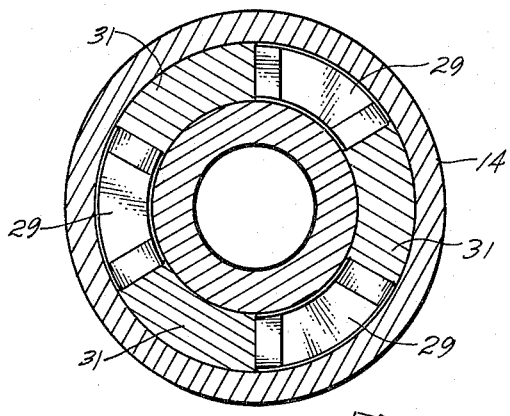
FIG. 6 is a transverse cross section at torque transmitting splines within the underreamer.

The lower body 11 extends upwardly from the location of the cutter arms and terminates in three fingers or splines 29 at its upper end. The ends of these three splines each of which is 60° wide is seen in FIG. 6. The three splines 29 on the lower body are interspersed between three similar splines or fingers 31 on an upper body 32. The upper body 32 has a male thread (not shown) at its upper end which is connected to a corresponding female thread in the lower end of the latching selector sub 16.

A camming plunger 36 is secured to the upper body 32 by a pair of roll pins 37 and a transversely extending shear pin 38. These maintain the camming plunger 36 in fixed rotational and longitudinal position relative to the upper body. At the lower end of the camming plunger there are a pair of cam faces 39. The two cam faces 39 face in opposite directions at an angle of about 45° to the axis of the underreamer. Each of the cam faces 39 is opposite the respective curved following surface 25 on the upper end 24 of one of the cutter arms 19. A pocket 41 is provided above each of the camming surfaces 39.

The lower body 11 and upper body 32 are free to telescope relative to each other to a limited extent. Thus, for example, as illustrated in FIG. 2 when the underreamer is hanging free suspended from above by the drill string without an upward force on the lower end thereof, the lower body drops relative to the upper body. When the underreamer is in this relatively longer position the cutter arms 19 are free to pivot so that the cutters 22 are retracted to a position within the external contour of the underreamer. A gap opens up between the extreme ends of the splines 29 and 31 and the roots of the corresponding splines 31 and 29 respectively. The extent of drop of the lower body relative to the upper body is limited by a pair of interengaging shoulders 42 on the upper body 32 and sleeve 14 respectively.

When the underreamer is in this relatively longer position as illustrated in FIG. 2 torque is transmitted via the drill string to the upper body 32 and through the interengaging splines 31 and 29 to the lower body 11. This in turn transmits the torque to lower portions 12 of the drill string such as, for example, a pilot drill (not shown).

When the lower end of the drill string engages the bottom of a hole the weight of the drill string on the upper body applies a compression force to the underreamer, tending to collapse the telescoping upper and lower bodies, thereby closing the gap at the splines and opening a gap between the shoulders 42 as illustrated in FIG. 3. As the upper body telescopes relative to the lower body towards this shorter position the camming faces 39 on the plunger 36 engage the followers 25 on the upper ends of the cutter arms 19. These camming surfaces spread the upper ends 24 of the cutter arms apart and since they are mounted in scissors fashion on the pivot pin 21, the lower ends 23 of the cutter arms are also pivoted outwardly. This causes the cutters 22 to be extended towards their underreaming position. As the followers reach the ends of the camming faces 39 they are accommodated within the pockets 41 in the plunger. The outward extent of the cutters is limited by engagement of the shoulder 28 on each cutter arm with the respective stop lug 27.

Thus as the drill string is lowered in a hole the weight of the lower end thereof keeps the underreamer in its relatively longer position and permits the cutter arms 19 to remain in their retracted position as shown in FIG. 2. When the bottom of the drill string engages the bottom of the hole the upper and lower bodies of the underreamer telescope towards each other and the camming plunger urges the cutter arms relatively outwardly in a scissors fashion for enlarging the diameter of the hole.

Another feature of the preferred underreamer is the air cooling available. The camming plunger 36 has an axial bore 43 extending from its upper end and terminating short of the camming surfaces 39. This transverse bore receives compressed air through the upper portion of the drill string. An elongated opening 44 extends through the side of the camming plunger near the lower end of the bore 43. Seals 46 above and below the transverse opening 44 limit air leakage.

Figure 5:
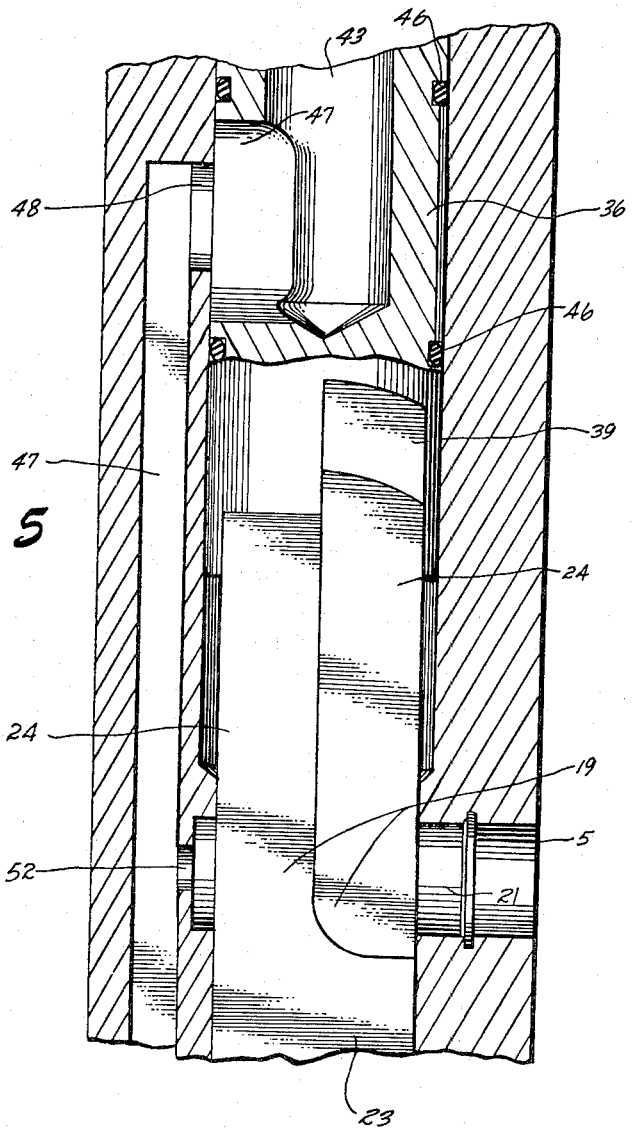
FIG. 5 is a fragmentary longitudinal cross section transverse to the cross sections of FIGS. 2 and 3.

A passage 47 is provided along one side of the lower body 11 as best seen in FIGS. 4 and 5. A transverse hole 48 provides fluid communication between the passage 47 and the region between the seals 46 on the camming plunger. Another opening 49 (FIGS. 2 and 3) at the lower end of the passage 47 admits compressed air to the region above the threaded joint 13 leading to the lower end of the drill string. With such an arrangement compressed air comes down the drill string through the bore 43 and the opening 44 into the region between the seals 46 between the camming plunger and the lower body. Air then flows through the opening 48 and passage 47 to exit from the lower opening 49 into the lower portion of the drill string.

Figure 8:
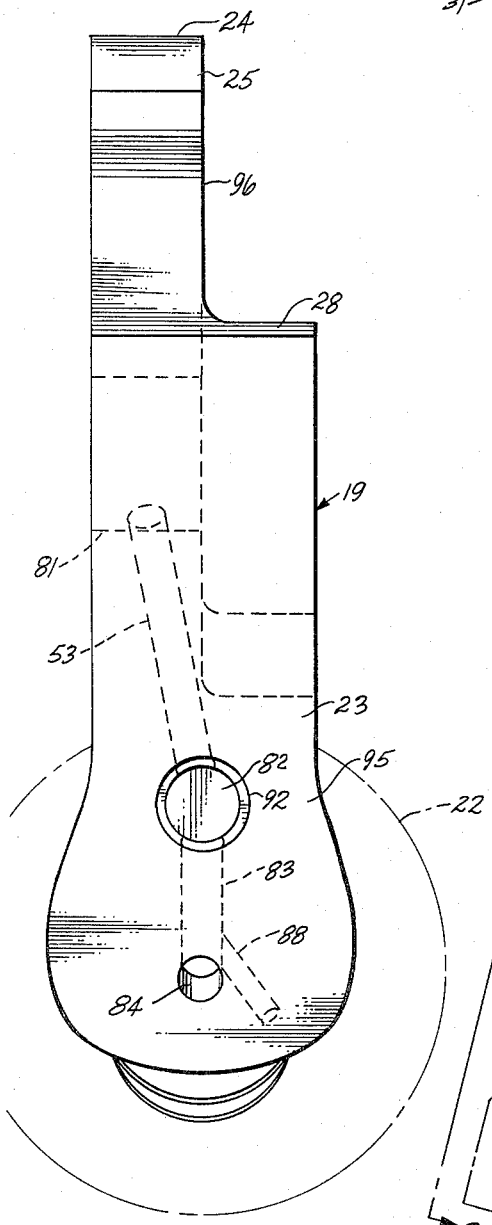
FIG. 8 is a view of the outside face of the cutter arm.
Figure 7:
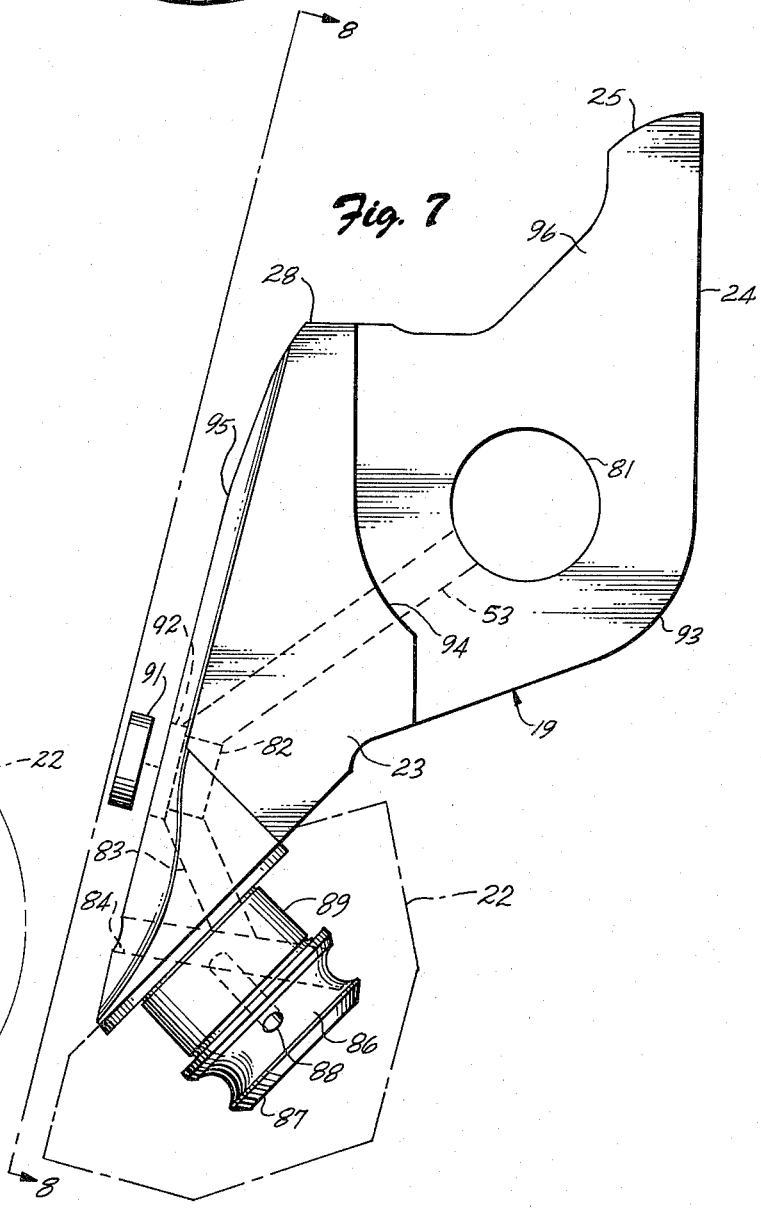
FIG. 7 is a side view of one of the cutter arms for the underreamer.

Compressed air is used during drilling of blast holes and the like for removing the pulverized formation and cooling the cutters and bearings. It is therefore desirable that the cooling air be delivered as near as possible to the bearings in the cutters. As seen in FIG. 4 the pivot pin 21 is provided with an axially extending bore 51 which is in fluid communication with the longitudinally extending passage 47 through the lower body by way of a transverse hole 52. Each of the cutter arms 19 is provided with an internal air passage 53 one end of which is in fluid communication with a transverse hole 81 through which the pivot pin 21 fits for mounting the cutter arms. As best seen in FIGS. 7 and 8, the air passages through the respective arms are arranged in non-straight paths for ease of manufacture.

A shallow pocket 82 is formed on the face of the cutter arm that is on the outside of the underreamer as it is installed. This pocket provides access for drilling the air passage 53 and also an air passage 83 skewed from the first passage 53 and directed towards the journal on which the cutter cone 22 is mounted. This second air passage intersects a ball passage 84 extending from the outside face of the cutter arm to a ball bearing race 86 on the cutter journal 87. When the cutter cone is mounted on the journal with its axis of rotation transverse to the pivot pin axis, ball bearings (not shown) are inserted through the ball passage 84 to provide rotational support and lock the cutter cone on the journal. A ball retainer (not shown) is inserted through the ball passage 84 and welded in place to retain the ball bearings in the race. The mounting of the cutter cone on the journal is conventional.

The air passage 53 from the pivot pin 81 to the pocket 82 is skewed somewhat relative to the length of the cutter arm. This is the case since the pocket is centered in the full width portion and it is preferred that the intersection of the air passage with the pivot pin hole also be centered within the half width portion. This helps assure that the two cutter arms mounted on the pivot pin are symmetrical for best air flow.

One or more air distribution passages 88 extend from the ball passage 84 to the ball bearing race 86. If desired, other air passages may extend to the nose bearing pin (not shown) or roller bearing race 89 on the journal.

After the air passages 53 and 83 are drilled, a plug 91 is welded into a counter bore 92 adjacent the pocket so that it is sealed. Thus, air flow is from the pivot pin hole 81 through the through the air passage 53 to the pocket 82. Air continues to flow through the air passage 83 to the ball passage 84 where it is diverted to one or more distribution passages 88. Air discharging in the bearing structure of the cutter cone provides cooling and also prevents accumulation of abrasive rock chips in the cutter cone bearings. The discharged air also helps carry chips up the bore hole in a conventional manner.

A recessed portion 54 is provided around the pivot pin to provide fluid communication between a pair of transverse orifices 56 from the bore 51 in the pivot pin to the passage 53 in the respective cutter arm. In this manner a portion of the air passing through the passage 47 is diverted through the pivot pin to discharge adjacent the two cutter bearings of the underreamer. This provides parallel air flow to the cutters of the underreamer and to a pilot drill (not shown) lower down on the drill string, thereby assuring that all bearing surfaces are adequately cooled and kept clear of chips.

It will also be noted in FIGS. 4 and 5 that the pivot pin 21 is held in place by a snap ring 57 and a tapped hole 58 is provided in the end of the pin as an aid in assembling and disassembling the underreamer.

The cutter arms 19 are illustrated in detail in FIGS. 7 and 8. As illustrated in this embodiment each of the arms has a full width portion 23 adjacent one end and a half width portion 24 adjacent the other end. The half width portion 24 is offset from the full width 23 so that one side is essentially an extension of one face of the full width portion. The half width portion also has a flat inner face 96 in a plane that bisects the full width portion. The pivot pin hole 81 extends through the half width portion.

The outer faces 95 of the full width portion which may rub on the sides of the hole during drilling are typically faced with a hard facing alloy deposited by welding or have wear resistant tungsten carbide inserts pressed into holes (not shown). This minimizes wear on the arms and prolongs their life.

As mentioned above, a pair of cutter mounting arms are mounted on a pivot pin with the two inner faces 96 of the half width portions 24 in engagement. This places the cam follower portions 25 in opposition for actuation by the cam faces 39 (FIGS. 2 and 3). Since this causes the arms to move in scissors fashion clearance for such motion must be provided. There is an outer rounded face 93 on the half width portion centered on the axis of the pivot pin hole and facing away from it. This provides a maximum amount of steel in this portion for greater strength. A rounded half face 94 is provided in the end of that portion of the full width part of the body adjacent the half width portion. This rounded half face 94 faces towards the axis of the pivot pin hole and is centered thereon. The radius of this half face is greater than that of the rounded face 93 on the half width portion so that the two half width portions on a similar pair of cutter arms nest to define an extension of the full length portions of the two arms. This permits the two arms to pivot through at least a limited angle around the axis of the pivot pin hole when the arms are mounted in the underreamer. Variations in these rounded faces can, of course, be provided so long as there remains clearance between the half and full width portions so that the two arms can pivot.

It will be noted that the cam follower portion 25 on the half width portion and the cutter mounting journal 87 on the full width portion face in the same rotational sense relative to the axis of the pivot pin hole 81 (e.g. both face counter clockwise in FIG. 7). This assures that the cutter cones move to their proper position when the arm is actuated in scissors fashion by the cam follower portions. The stop shoulder 28 on the cutter arm extends in the opposite rotational sense from the cutter mounting journal 87 and the cam following portion 25. This shoulder serves to limit rotation of the cutter arms and transmits most of the force from the cutters to the stop lugs 27 as mentioned above. Preferably this stop shoulder is at least partly on the full width portion to provide the greatest possible area of contact with the stop lugs.

As described to this point, application of the weight of the drill string to the lower end when it bottoms in the hole invariably causes the cutter arms to be extended to their underreaming position by action of the cam 39 on the upper ends of the arms. With such an arrangement it would be necessary to drill a pilot hole approximately to the depth where underreaming was desired and withdraw the drill string from the hole and install the underreamer. When the underreamer was lowered into the hole and bottomed, the underreamer arms would be cammed outwardly and underreaming could commence. It is, however, desirable to perform such underreaming without round tripping the drill out of the hole and installing additional tools. A latching selector sub 16 is therefore used in combination with the underreamer in many situations. Details of the latching selector sub are provided in my aforementioned patent.

If it is desired to drill a pilot hole with the underreamer and selector sub in position, the drill string is lowered into a hole and the air pressure applied before the drill string reaches the bottom of the hole and causes telescoping of the underreamer. The air pressure causes the selector sub to latch the sleeve 14 in a lower position and prevent telescoping of the upper and lower bodies. This retains the cutter arms in their retracted position and permits drilling with the pilot drill.

At such time as a depth is reached where it is desired to underream the hole, the drill string is raised a sufficient amount to remove the weight from the bottom of the hole. A few inches is enough. When the air pressure in the drill string is relieved the selector sub unlatches. Thereafter when the drill string is lowered so that the weight thereof is on the bottom and hence applied to the lower body, the underreamer telescopes and the cutter arms are urged outwardly. Typically only a few rotations of the drill string are required to assure that the cutter arms have substantially completely extended. Thereafter air pressure can be applied for cooling the cutter bearings and removing chips.

In summary, if one wishes to simply drill, air pressure is applied to the combined latching selector sub and underreamer prior to reaching the bottom of the hole and then drilling can proceed in the customary manner. If it is desired to underream a portion of the hole air pressure can be turned off and the consequent upward motion of the piston permits telescoping of the upper and lower bodies and extension of the cutter arms. It is preferable to lift the drill string slightly from the bottom of the hole before applying or relieving air pressure. After underreaming for some desired distance the drill string can be lifted a few inches for extending the underreamer to its relatively longer position. Application off air pressure latches the sleeve in its lower position. Continued drilling can then be conducted without removing the drill string from the hole. Thus, if desired, one can produce a hole having a number of alternating relatively larger and relatively smaller diameters. These enlarged portions of the hole can then be filled with explosives for mining operations.

Although limited embodiments of cutter arm for scissors actuation and fluid cooling have been described and illustrated herein, many modifications and variations will be apparent to one skilled in the art. It is therefore to be understood that within the scope of the appended claims the invention may be practiced otherwise than as specifically described.

What is claimed is:

1. An underreamer cutter arm comprising:
an elongated body;
a transverse pivot pin hole through the body;
cam surface means on the body for pivoting the body about the axis of the pivot pin hole;
journal means on one end of the body for mounting a rock cutter cone for rotation about an axis transverse to the axis of the pivot pin hole; and
a fluid flow passage through the body between the pivot pin hole and the journal means comprising:
a first straight passage portion having one end in fluid communication with the pivot pin hole and the other end terminating within the body;
a second straight passage portion having one end in fluid communication with the journal means and the other end terminating within the body in fluid communication with the first passage portion, the first and second passage portions being skewed relative to each other for conducting fluid along a non-straight path between the pivot pin hole and the journal means.

2. An underreamer cutter arm as defined in claim 1 wherein the journal means includes a ball bearing race and further comprising at least one fluid flow passage in fluid communication between the second passage portion and the ball bearing race.

3. An underreamer cutter arm comprising:
an elongated body;
journal means on one end of the body for mounting a cutter cone for rotation about an axis transverse to the axis of the pivot pin hole;
camming surface means on the other end of the body from the journal means for pivoting the body about the axis of the pivot pin hole, the camming surface and the journal means facing in the same rotational sense relative to the axis of the pivot pin hole;
a full width portion at the journal means end of the body,
a half width portion at the camming surface means end of the body, the half width portion being offset from the full width portion with an outer face being essentially an extension of the full width portion and an inner face parallel to the outer face and in a plane bisecting the full width portion; and
a transverse pivot pin hole extending through the half width portion of the body.

4. An underreamer cutter arm as defined in claim 3 further comprising:
a fluid flow passage through the body from the pivot pin hole to the journal means.

5. An underreamer cutter arm as defined in claim 3, further comprising a shoulder facing in the opposite rotational sense relative to the axis of the pivot pin from the journal means for limiting the extent of rotation of the cutter arm around the pivot pin hole.

6. An underreamer cutter arm as defined in claim 5 wherein
the shoulder is at least partly on the full width portion.

7. An underreamer cutter arm comprising:
a body having a full width portion at one end and a half width portion at the other end, the half width portion being offset from the full width portion with an outer face being an extension of one face of the full width portion and an inner face being parallel to the two faces of the full width portion and half way therebetween;
a transverse pivot pin hole through the half width portion;
a camming surface at the end of the half width portion remote from the full width portion;
journal means for mounting a rock cutter cone on the end of the full width portion remote from the half width portion, the means for mounting and the camming surface facing in the same rotational sense relative to the axis of the pivot pin hole; and
a fluid flow passage extending from an intermediate portion of the pivot pin hole remote from the outer and inner faces of the half width portion to a portion of the journal means for fluid flow from the pivot pin hole to a region of the journal means within a conventional rock cutter cone when mounted thereon.

8. In combination with a pair of cutter arms as defined in claim 7, a pivot pin having a diameter about the same as the diameter of the pivot pin hole and a length greater than the thickness of the full width portion; an axial bore in the pivot pin in fluid communication with one end thereof; a pair of circumferentially extending recessed portions around the pivot pin and axially spaced apart approximately the same as the thickness of the half width portion of the body; and a pair of transverse orifices between the axial bore and the respective recessed portions.

9. An underreamer cutter arm as defined in claim 7 further comprising a stop shoulder on the body facing in the opposite rotational sense relative to the axis of the pivot pin hole from the journal means, said stop shoulder being at least partly on the full width portion.

10. An underreamer cutter arm as defined in claim 9 further comprising:

a rounded face on the half width portion centered on the axis of the pivot pin hole facing away from the pivot pin hole on the same side of the body as the journal means; and a rounded half face on the end of the full width portion adjacent the half width portion centered on the axis of the pivot pin hole and facing in a direction towards said axis, the radius to the half face being greater than the radius to the rounded face on the half width portion, so that the two half width portions on a similar pair of cutter arms can nest to define an extension of the full length portions, and the arms can pivot through at least a limited angle around the axis when the two inner faces, respectively, are face to face with the axes of the two pivot pin holes coaxial.

11. An underreamer arm as defined in claim 9 wherein the fluid flow passage comprises:

a first straight passage portion having one end in fluid communication with the pivot pin hole and the other end terminating within the body;

a second straight passage portion having one end in fluid communication with the journal means and the other end terminating within the body in fluid communication with the first passage portion, the first and second passage portions being skewed relative to each other for conducting fluid along a non-straight path between the pivot pin hole and the journal means.

12. An underreamer cutter arm as defined in claim 11 wherein the journal means includes a ball bearing race and further comprising at least one fluid flow passage in fluid communication between the second passage portion and the ball bearing race.

* * * * *